United States Patent [19]

Lisowski

[11] Patent Number: 4,907,298

[45] Date of Patent: Mar. 13, 1990

[54] CONVERTIBLE PANTS/MINISHORTS

[75] Inventor: Adam Lisowski, Los Angeles, Calif.

[73] Assignee: International Fashion Garments Ltd., Bangkok, Thailand

[21] Appl. No.: 138,295

[22] Filed: Dec. 28, 1987

[51] Int. Cl.[4] ..... A41D 15/02

[52] U.S. Cl. ..... 2/212; 2/71

[58] Field of Search ..... 2/212, 213, 227, 71, 2/72

[56] References Cited

U.S. PATENT DOCUMENTS

| | | | |
|---|---|---|---|
| 1,247,053 | 11/1917 | Wilson | 2/212 |
| 1,250,004 | 12/1917 | Philip | 2/213 |
| 1,629,561 | 5/1927 | Wellstatter | 2/213 |
| 2,099,478 | 11/1937 | Gurian | 2/213 |
| 2,665,428 | 1/1954 | Bowley | 2/212 |
| 2,756,433 | 7/1956 | Jones | 2/212 |
| 2,758,312 | 8/1956 | Goldstein | 2/212 |
| 3,315,274 | 4/1967 | Roody | 2/212 |
| 3,859,667 | 1/1975 | Roy | 2/212 |

*Primary Examiner*—Werner H. Schroeder
*Assistant Examiner*—Jeanette E. Chapman
*Attorney, Agent, or Firm*—Spensley, Horn, Jubas & Lubitz

[57] ABSTRACT

A pair of pants is provided having frontal and rear closure devices for selectively closing the front and rear of the pant legs portions so that the garment may assume the appearance of a skirt.

6 Claims, 2 Drawing Sheets

CONVERTIBLE PANTS/MINISHORTS

BACKGROUND OF THE INVENTION

1. Field of the Invention

The present invention relates to clothing, and more particularly, to women's clothing including pants and skirts.

2. Description of Related Art

Women's pants are in general comfortable to wear and are proper attire for a variety of occasions. However, for many activities, pants and particularly short pants (hereinafter referred to simply as "shorts") are inappropriate and more formal attire such as skirts are preferred. Currently, very short hem lines (as represented by "miniskirts") are in fashion and maintaining a certain amount of modesty while wearing these short skirts, can be challenging, particularly when entering or exiting automobiles.

Certain shorts have previously been designed to have the appearance of a skirt. In such designs, the leg portions of the shorts are typically cut very full so that the leg portions abut when the wearer is standing. However, once the wearer moves about, it is readily apparent that shorts and not a skirt is being worn.

SUMMARY OF THE INVENTION

It is an object of the present invention to provide an improved garment obviating for practical purposes, the above mentioned limitations.

In accordance with the present invention, an article of women's clothing is provided which has the flexibility of being worn either as a skirt or as a pair of pants. This is achieved by, in the illustrated embodiment, providing a first zipper or other fastener along the front of the leg portions of the garment and a second zipper or other fastener along the back of the leg portions. When the front and back zippers of the garment are closed, the garment has the appearance of a skirt. By merely opening the zippers, the garment resumes the appearance of a pair of pants. Alternatively, the zippers can be unzipped partially to provide a unique appearance of a composite garment.

DETAILED DESCRIPTION OF THE DRAWINGS

Figure 1:
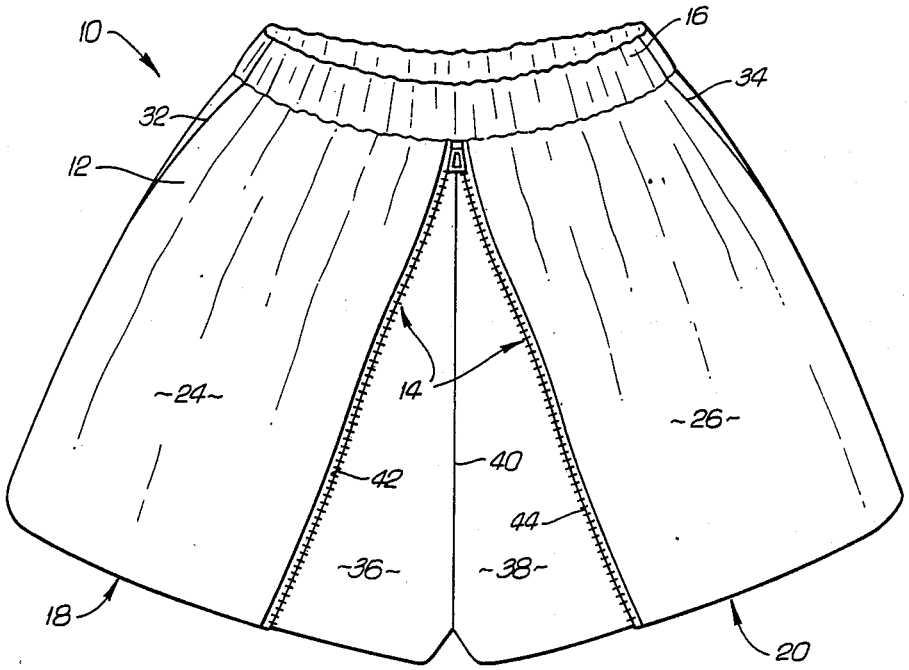
FIG. 1 is a front perspective view of a garment in accordance with a preferred embodiment of the present invention, showing the zippers opened such that the garment has the appearance of a pair of pants.

Referring now to FIG. 1, a garment in accordance with a preferred embodiment of the present invention is indicated generally at 10. The garment 10 includes a pair of short pants ("shorts") 12 which has a longitudinal frontal zipper 14 which extends from the waist band 16 of the pants 12, along the front of the pants, to the bottom of the leg portions 18 and 20. A similar rear zipper 22 (FIG. 2) extends longitudinally along the rear of the pants 12.

Figure 2:
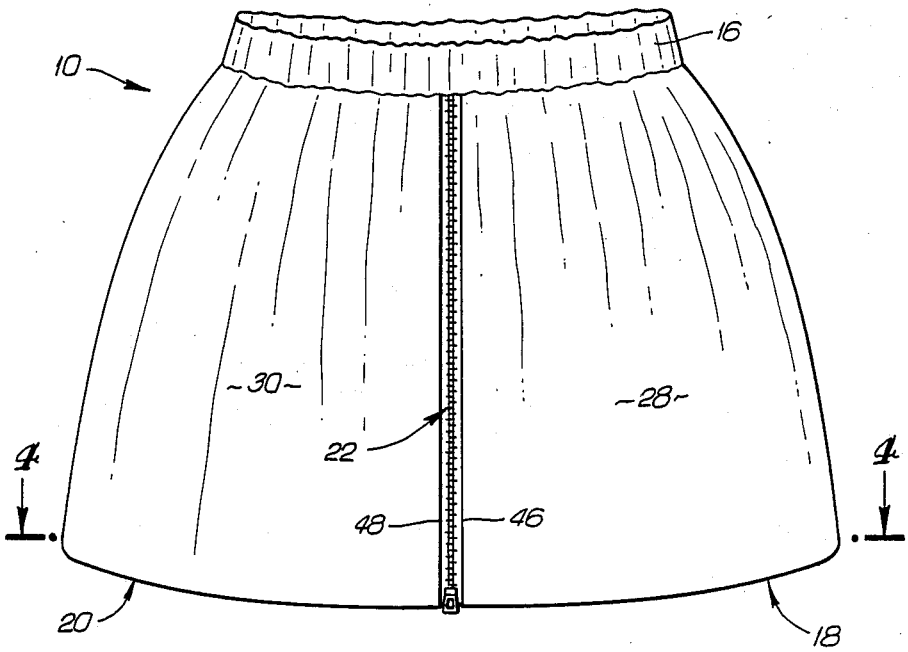
FIG. 2 is a rear perspective view of the garment of FIG. 1 showing the zippers closed such that the garment has the appearance of a skirt.

As shown in FIG. 1, when the zippers 14 and 22 are open, the garment 10 has the appearance of a conventional pair of shorts. However, when the zippers 14 and 22 are closed, the garment 10 has the appearance of a skirt as shown in FIG. 2. Although the garment 10 of the illustrated embodiment is shown employing zippers, it is recognized that other fastener and closure devices such as buttons, snaps, and hook and loop ("Velcro") may also be suitably used.

The garment 10 includes generally rectangular right front and left front panels 24 and 26, respectively, and generally rectangular right rear and left rear panels 28 and 30, respectively (FIG. 2). The right front panel 24 and right rear panel 28 are adjoined at a side seam 32. Similarly, the left front panel 26 and left rear panel 30 are adjoined at a side seam 34.

The front of the garment 10 further has a pair of generally triangular front gusset insert panels which are adjoined at a generally arcuate center crotch seam 40. The frontal zipper 14 includes a pair of facing zipper tapes 42 and 44, respectively, wherein the right zipper tape 42 is adjoined to the right longitudinal edge of the right front gusset panel 36 and the left edge of the right front panel 24. Conversely, the left zipper tape 44 is adjoined to the left longitudinal edge of the left front gusset panel 38 and the right longitudinal edge of the left front panel 26. The rear of the garment 10 similarly has rear zipper tapes 46 and 48 and right and left rear gusset panels 50 and 52, respectively, (FIG. 3) adjoined in a similar fashion to the rear panels 28 and 30. Each zipper has a slide 53 which fastens and unfastens the zipper tapes of the zipper as the slide is slid down and up, respectively.

Figure 3:
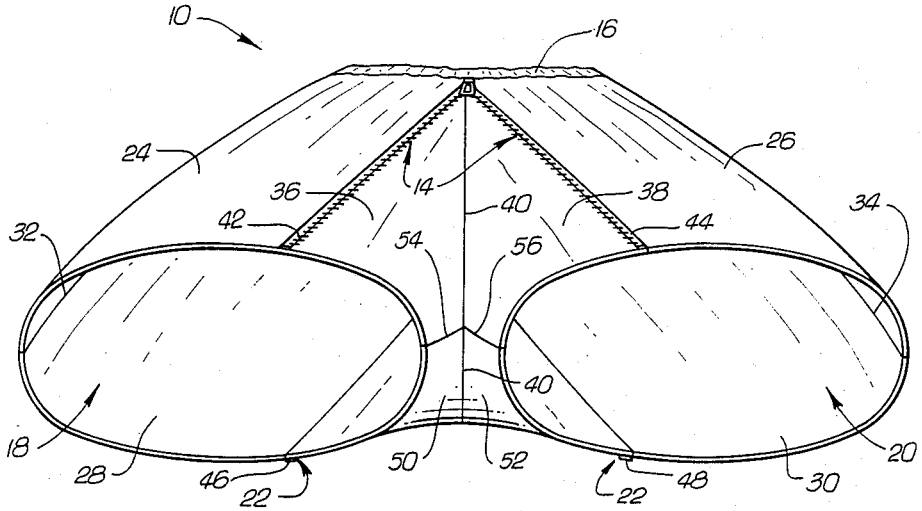
FIG. 3 is a bottom view of the garment of FIG. 1.

As shown in FIG. 3, a right inseam 54 adjoins the rear edge of the right front gusset panel 36 to the front edge of the right rear gusset panel 50, forming the interior of the right leg portion 18. Similarly, a left inseam 56 adjoins the rear edge of the left front gusset panel 38 to the front edge of the left rear gusset panel 52, forming the interior of the left leg portion 20.

Figure 4:
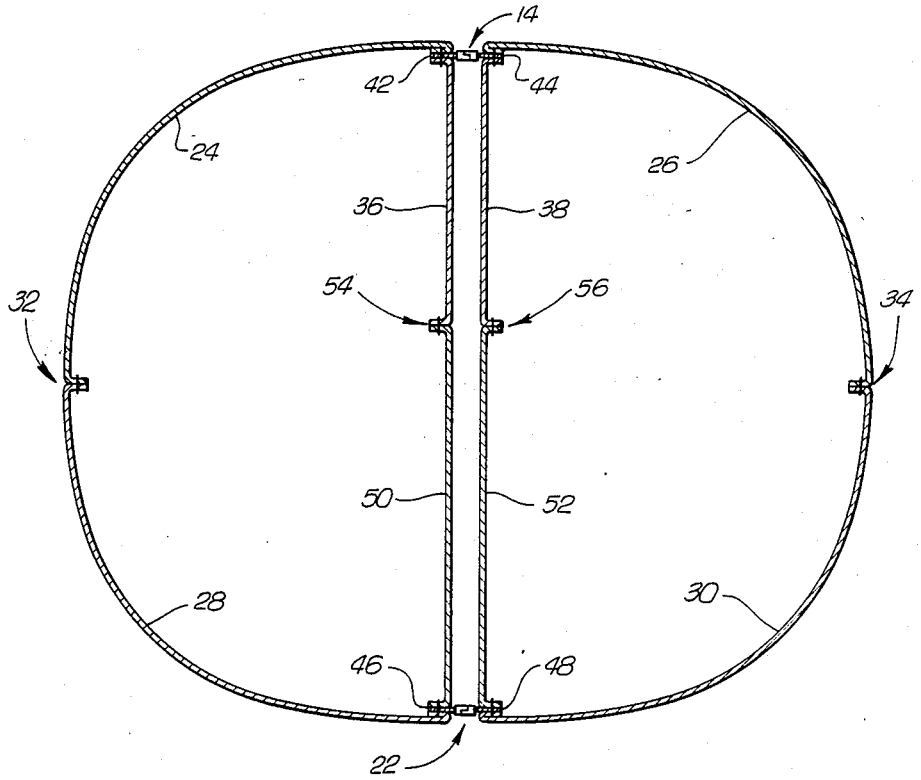
FIG. 4 is a cross-sectional view of the garment of FIG. 2 viewed along the line 4—4 of FIG. 2.

Referring now to FIGS. 2 and 4, when the frontal zipper 14 is closed, the front panels 24 and 26 are joined together from the waist band 16 all the way to the bottom of the garment such that the front gusset panels 36 and 38 are hidden from view. Consequently, the front of the garment has the appearance of a skirt when the frontal zipper 14 is closed. Similarly, when the rear zipper 22 is closed, the rear of the garment 10 has the appearance of a skirt.

Alternatively, when the zippers 14 and 22 are open, the gusset panels are visible such that the garment resumes the appearance of a pair of shorts. The wearer may also optionally open or close the zippers only partially such that the garment has the appearance of a "composite" skirt and pants.

Although the garment 10 of the illustrated embodiment has relatively short leg portions such that the garment is convertible into a very short skirt or "miniskirt", it is recognized that the leg portions may be extended longer than that shown such that the garment is convertible into a longer type of skirt. Other embodiments are also possible with specific designs depending upon the particular application. As such, the invention should not be limited to the embodiments herein described but only by the appended claims and equivalents thereof.

What is claimed is:

1. An article of clothing comprising:

pants having a pair of leg portions;

frontal closure means for selectively closing the front of the leg portions together; and rear closure means for selectively closing the rear of the leg portions together;

wherein the clothing article has the appearance of a skirt when the front and rear of the leg portions are respectively closed.

2. The article of clothing of claim 1 wherein the pants are short pants.

3. The article of clothing of claim 1 wherein the closure means and rear closure means each comprises a zipper.

4. The article of clothing of claim 3 further comprising a waist band and wherein each zipper includes a pair of zipper tapes, each tape being adjoined at one end adjacent the waist band and adjoined at the other end to the bottom of a leg portion so that when each zipper is closed, the front zipper tapes secure the front of the leg portions together and the rear zipper tapes secure the rear of the leg portions together.

5. An article of clothing comprising:

pants having a pair of leg portions;

a frontal fastener for selectively fastening the front of the leg portions together; and a rear fastener for selectively fastening the rear of the leg portions together;

wherein the clothing article has the appearance of a skirt when the front and rear of the leg portions are respectively fastened.

6. An article of clothing comprising:

pants having a waist band and a pair of leg portions;

a frontal zipper comprising a first longitudinal front zipper tape extending from adjacent the front of the waist band, along the front of one leg portion and to the bottom of the one leg portion, a second longitudinal front zipper tape extending from adjacent the front of the waist band and the first zipper tape, along the front of the other leg portion and to the bottom of the other leg portion, and a front slide for fastening and unfastening the front zipper tapes so that the front of the pants has the appearance of a skirt when the frontal zipper tapes are fastened; and a rear zipper comprising a first longitudinal rear zipper tape extending from adjacent the rear of the waist band, along the rear of the one leg portion and to the bottom of the one leg portion, a second longitudinal rear zipper tape extending from adjacent the rear of the waist band and the first rear zipper tape, along the rear of the other leg portion and to the bottom of the other leg portion and a rear slide for fastening and unfastening the rear zipper tapes so that the rear of the pants has the appearance of a skirt when the rear zipper tapes are fastened.

* * * * *